US008657166B1

(12) United States Patent
Harness

(10) Patent No.: US 8,657,166 B1
(45) Date of Patent: Feb. 25, 2014

(54) BACK SUPPORT LIFTING DEVICE FOR EMERGENCY PERSONNEL

(76) Inventor: David S. Harness, Buffalo, WY (US)

( * ) Notice: Subject to any disclaimer, the term of this patent is extended or adjusted under 35 U.S.C. 154(b) by 997 days.

(21) Appl. No.: 12/700,480

(22) Filed: Feb. 4, 2010

Related U.S. Application Data

(60) Provisional application No. 61/206,653, filed on Feb. 4, 2009.

(51) Int. Cl.
*A45F 3/04* (2006.01)
*A45F 5/00* (2006.01)

(52) U.S. Cl.
USPC ..... 224/259; 224/260; 224/268

(58) Field of Classification Search
USPC ..... 224/157, 259, 260, 268, 646, 254, 257, 224/651, 258, 600, 606, 607, 609, 621, 627, 224/639
See application file for complete search history.

(56) References Cited

U.S. PATENT DOCUMENTS

| | | | | | |
|---|---|---|---|---|---|
| 148,744 | A * | 3/1874 | Parent | 182/8 |
| 1,178,628 | A * | 4/1916 | Reece et al. | 224/259 |
| 1,727,873 | A * | 9/1929 | Farmer, Jr. | 224/260 |
| 1,736,131 | A * | 11/1929 | Reece et al. | 224/646 |
| 1,879,480 | A * | 9/1932 | Pures | 224/260 |
| 2,643,803 | A * | 6/1953 | Bates | 224/254 |
| 3,181,752 | A | 5/1965 | Seltzer et al. | |
| 3,486,671 | A | 12/1969 | Sanders | |
| 4,280,645 | A | 7/1981 | Goodden | |
| 4,739,526 | A | 4/1988 | Hollick | |
| 5,009,349 | A | 4/1991 | Eide et al. | |
| 6,006,970 | A * | 12/1999 | Piatt | 224/257 |
| 6,409,060 | B2 * | 6/2002 | Donine | 224/160 |
| 6,508,389 | B1 | 1/2003 | Ripoyla et al. | |
| 6,729,511 | B2 * | 5/2004 | Dent, III | 224/259 |
| 2002/0148866 | A1 * | 10/2002 | Dent, III | 224/259 |
| 2005/0279791 | A1 * | 12/2005 | Komorowski | 224/260 |
| 2009/0014483 | A1 * | 1/2009 | Green et al. | 224/157 |
| 2009/0294500 | A1 * | 12/2009 | Brown et al. | 224/651 |

* cited by examiner

*Primary Examiner* — Brian D Nash
*Assistant Examiner* — Corey Skurdal
(74) *Attorney, Agent, or Firm* — Robert C. Montgomery; Montgomery Patent & Designs

(57) ABSTRACT

An apparatus that aids emergency personnel in transporting and carrying incapacitated people on stretchers or similar devices is herein disclosed. The apparatus comprises a belt worn by a user around the lower or middle back. The belt is designed to prevent back strain and injury by keeping the spine aligned and by forcing the user to maintain a proper posture when lifting a patient. The apparatus also comprises a harness to give additional support to the back and non-captive hook positioned on either the front or buckle area of the belt. The hook aids in supporting the stretcher or gurney when the user of the apparatus is an upright position. Its non-captive design allows for quick disconnection should the user stumble, fall or lose their balance.

16 Claims, 3 Drawing Sheets

BACK SUPPORT LIFTING DEVICE FOR EMERGENCY PERSONNEL

RELATED APPLICATIONS

The present invention was first described in and claims the benefit of U.S. Provisional Application No. 61/206,653, filed Feb. 4, 2009, the entire disclosures of which are incorporated herein by reference.

FIELD OF THE INVENTION

The present invention relates generally to support harnesses, and in particular, to a support harness adapted for assisting emergency response personnel in the movement of stretchers and other forms of patient transport in a physically supportive manner.

BACKGROUND OF THE INVENTION

Patient transport is a critical aspect of emergency response operations. In many cases when a patient is injured, the movement of the patient between their initial position and the location of their medical treatment is a dangerous process which must nevertheless be undertaken with great haste. In particular, the process of picking up a patient in a safe manner and transporting them into the bed of an ambulance or the like is difficult on both patient and emergency personnel. As such, wide range of different types and variations of patient lifting devices are utilized with regularity, including stretchers, backboards, gurneys, and the like.

As mentioned, the process of picking up a patient in a safe manner and transporting them into the bed of an ambulance or the like can be very physically strenuous on the attendant emergency personnel. In an effort to both make haste in attending to a patient and keep them in a safe, secure position, a medic is prone to neglect their own posture and physical safety. Prolonged improper posture and lifting procedure consistently leads to back, knee, or other long term injuries and lifelong discomfiture. Also, such practices can subtly endanger the patient as well.

Various attempts have been made to provide devices to assist in the stable lifting of unwieldy objects. Examples of these attempts can be seen by reference to several U.S. patents. U.S. Pat. No. 3,181,752, issued in the name of Seltzer et al., describes a means for carrying luggage, bags, and the like. The Seltzer device provides a harness with an attachment means for helping to support luggage and the like during prolonged carrying.

U.S. Pat. No. 4,739,526, issued in the name of Hollick, describes a lifting apparatus for use in lifting a disabled person or patient. The Hollick apparatus is a harness which may be worn by a disabled person in order to allow them to be more easily lifted by an external lifting apparatus.

U.S. Pat. No. 6,508,389, issued in the name of Ripoyla et al., describes a harness system for lifting objects. The Ripoyla device provides a means for a pair of people to more easily manipulate very heavy objects.

While these devices fulfill their respective, particular objectives, each of these references suffer from one (1) or more of the aforementioned disadvantages. Many such devices are only adaptable to particular types or sizes of objects. Also, many such devices do not provide a storage means for tools and other such objects which may be useful during such lifting operations. Furthermore, many such devices do not allow for use by a plurality of persons coordinating lifting on a single target. In addition, many such devices do not provide secure attachment means to common paramedic equipment used in the transport of people. Moreover, many such devices do not provide additional lifting handles which assist in the initial lifting of an object or patient in addition to supporting means for the subsequent stable transport of such an object or patient. Accordingly, there exists a need for a support harness without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a means to provide a support harness which assists a plurality of coordinating emergency response personnel in easily, quickly, and stably lifting a patient who is disposed upon a common paramedic transport device such as a stretcher or the like in a manner which is physical safe for both the patient and the personnel. Thus, the object of the present invention is to solve the aforementioned disadvantages and provide for this need.

To achieve the above objectives, it is an object of the present invention to comprise a lateral lift strap, a harness, a front hook, a neck pad, a pair of equipment pouches, a belt, and a sternum belt. The apparatus transfer weight off of the back of a user in order to encourage proper, safe lifting procedure.

Another object of the present invention is to comprise an adjustable belt fabricated in the manner of a common belt. The belt comprises a conventional lifting belt which encompasses a user's waist and provides lumbar support during lifting. The belt further comprises a common adjustable belt buckle.

Yet still another object of the present invention is to comprise two (2) removably attachable equipment pouches which provide a secure enclosure for tools and the like. The pouches are located on left and right front sides of the belt and attached via common hook-and-loop-type fasteners.

Yet still another object of the present invention is to comprise an adjustable harness which provides an adjustable stabilizing means in order to transfer additional lifted weight from a user's back to their legs.

Yet still another object of the present invention is to comprise the harness of a pair of vertical straps which comprise common harness shoulder straps attached to the belt on front and rear perimeter surfaces. The vertical straps further comprise a conventional length adjustment means in order to allow a user to adjust the harness to a desired length.

Yet still another object of the present invention is to comprise a lateral lifting strap to provide additional stability when initially lifting an emergency litter or the like. The lifting strap comprises a durable, flexible strap which extends from a side surface of the belt around the neck of a user and down to the opposite side surface. Each end of the lifting strap further comprises a non-captive lifting hook which hooks onto the emergency litter.

Yet still another object of the present invention is to further comprise the lateral lifting strap of a pair of lifting loops which comprise sewn-in textile loops. The lifting loops are located on opposite front surfaces of the lifting strap and provide a gripping means and lifting aid for a user's hands.

Yet still another object of the present invention is to further comprise the belt of a pair of sewn-in "D" hooks located at an intermediate vertical position along side surfaces of the belt. The hooks provide a secure position for the lifting hooks when not in use.

Yet still another object of the present invention is to comprise a sternum belt which provides an additional securing and adjustment means to the apparatus. The sternum belt is attached to inner perimeter surfaces of each of the vertical straps and oriented perpendicularly to them. The sternum belt further comprises a conventional adjustable buckling means.

Yet still another object of the present invention is to comprise a removably attachable non-captive hook fabricated from a durable material, which may be strapped into the belt or sternum belt. The hook provides an attachment and supporting means to an emergency litter.

Yet still another object of the present invention is to comprise a front hook of a belt anchor which attaches the front hook to the belt buckle or sternum belt buckle via a sliding attachment system, which provides quick fastening and detaching of the front hook.

Yet still another object of the present invention is to comprise an upper and lower support member for the front hook which are adapted to receive and sustain an emergency litter. The supports comprise "U"-shaped supports and provide a user with two height positions in which to rest the litter during use.

Yet still another object of the present invention is to comprise a neck pad which provides protection and comfort to the neck of a user which lifting heavy loads. The pad is affixed to a rear upper portion of the harness and directed toward the user. In a preferred embodiment, the neck pad is fabricated from a foam rubber.

Yet still another object of the present invention is to further comprise a plurality of strap guides on the neck pad which direct and contain the lateral lifting strap onto the load bearing area of a user's shoulders.

Yet still another object of the present invention is to provide a method of utilizing the device that provides a unique means of adjusting the harness to securely fit a user, selectively positioning the front hook, allowing a user or plurality of users to securely engage an emergency litter with front hook, selectively adjusting the lateral lifting strap in order to engage and stabilize the litter, utilizing the lifting loops to easily and safely lift the litter, and securely transport a patient on the litter.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

| | |
|---|---|
| 10 | back support harness lift aid |
| 20 | lateral lifting strap |
| 22 | lifting hook |
| 24 | lifting loop |
| 26 | strap guide |
| 30 | harness |
| 32 | first vertical strap |
| 34 | second vertical strap |
| 40 | loop |
| 50 | hook |
| 52 | upper support |
| 54 | lower support |
| 56 | belt anchor |
| 60 | neck pad |
| 70 | equipment pouch |
| 71 | pouch flap |
| 72 | flap hook fastener |
| 73 | flap loop fastener |
| 74 | internal surface |
| 75 | rear pouch loop fastener |
| 76 | belt hook fastener |
| 80 | belt |
| 82 | belt buckle |
| 84 | sternum belt |
| 85 | "D" hook |
| 86 | sternum belt buckle |
| 90 | user |
| 100 | length adjustment means |

DETAILED DESCRIPTION OF THE PREFERRED EMBODIMENT

Figure 1:
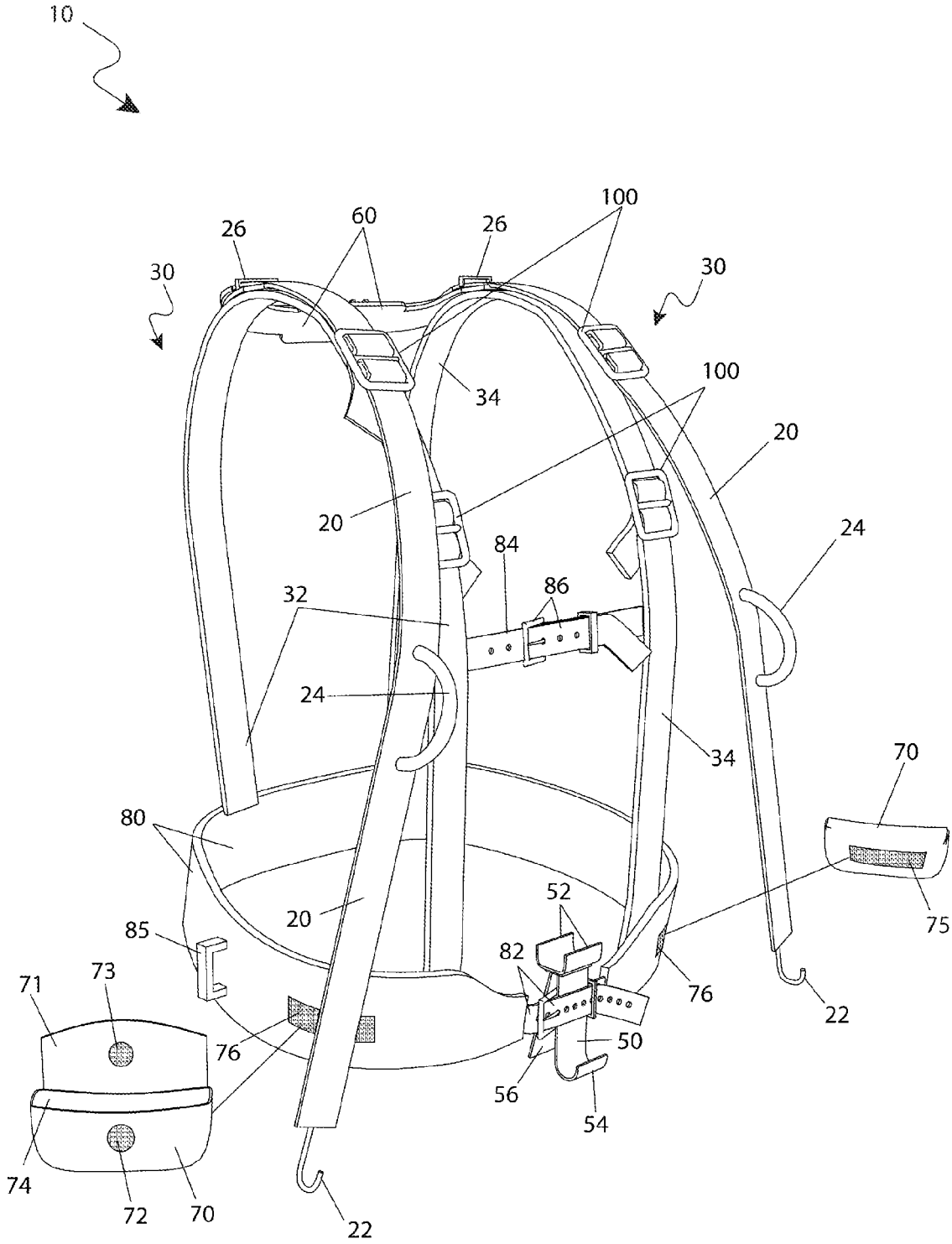
FIG. 1 is a perspective view of a back support harness lift aid 10, according to a preferred embodiment of the present invention.
Figure 2A:
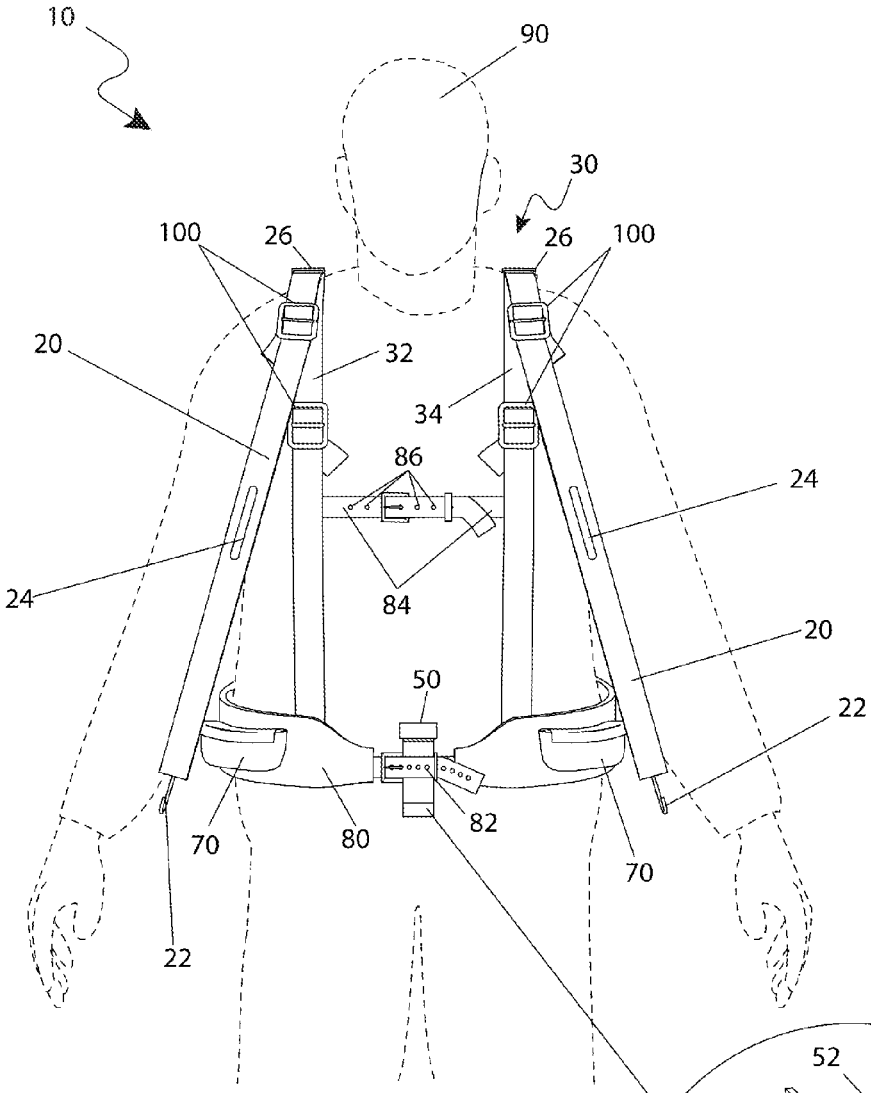
FIG. 2*a* is an environmental view of a front portion of the back support harness lift aid 10, according to a preferred embodiment of the present invention.
Figure 2B:
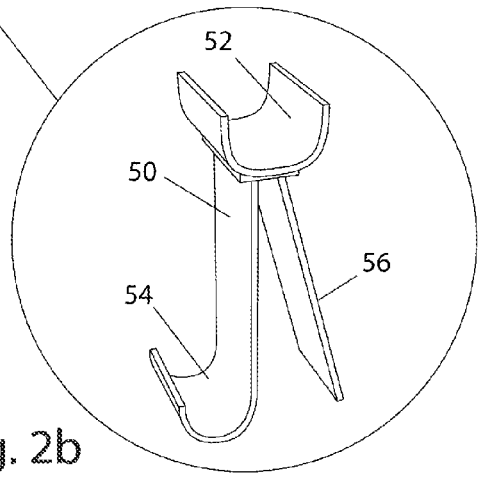
FIG. 2*b* is a close-up view of a hook portion 50 of the back support harness lift aid 10, according to a preferred embodiment of the present invention; and, FIG. 3 is an environmental view of a rear portion of the back support harness lift aid 10, according to a preferred embodiment of the present invention.
Figure 3:
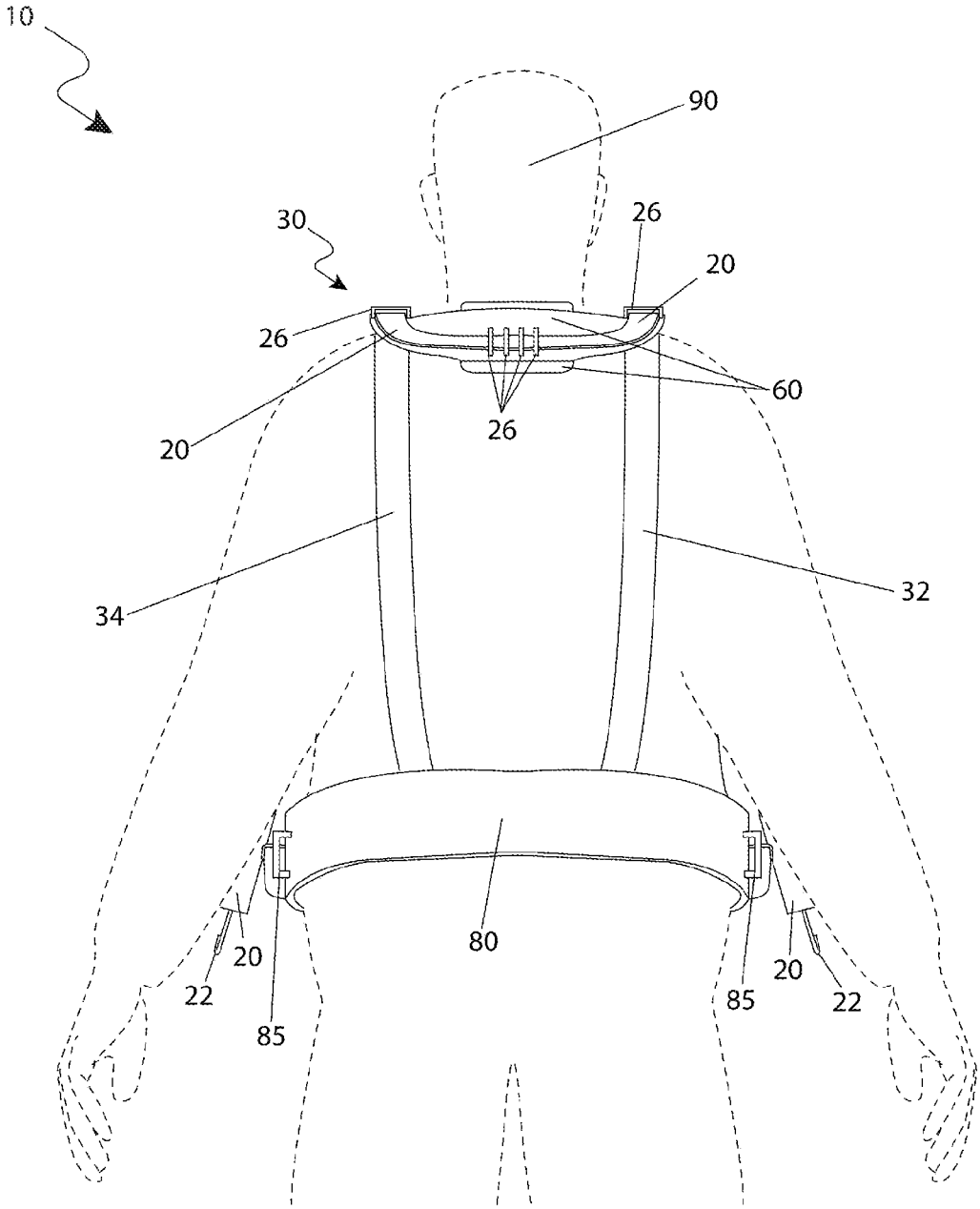

The best mode for carrying out the invention is presented in terms of its preferred embodiment, herein depicted within FIGS. 1 through 3. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a back support harness lift aid (herein described as the "apparatus") 10 which provides support to emergency personnel when transporting and carrying incapacitated persons with an emergency litter such as, but not limited to: a stretcher, a backboard, or a gurney. It is noted that, while using the apparatus 10, two (2) EMT/Paramedics are needed (one (1) at the head of the incapacitated person and one (1) at the feet of the incapacitated person), thereby completely lifting the emergency litter to an elevated horizontal position. The apparatus 10 comprises a lateral lift strap 20, a harness 30, a hook 50, a neck pad 60, a pair of equipment pouches 70, a belt 80, and a sternum belt 84. The apparatus 10 transfers weight off the back, is easily attached and removed, and ensures a proper lifting procedure for a user 90.

Referring now to FIG. 1, a perspective view of the apparatus 10, according to the preferred embodiment of the present invention, is disclosed. The apparatus 10 comprises an adjustable belt 80 fabricated from materials such as, but not limited to: leather, nylon, textile, or the like. The belt 80 is similar to conventional back belts or lifting belts which encompasses a user's 90 waist and protects the lower lumbar portion of the back during lifting of heavy loads. The belt 80 comprises a belt buckle 82 providing a securing and conforming means thereto users 90 of various waist sizes. The belt buckle 82 also provides a means for placement and securing of a hook 50. The belt buckle 82 comprises a conventional buckling fixture that fastens the ends of the belt 80 by techniques such as, but not limited to: apertures and a pivoting rod (similar to a conventional pant belt buckles), a belt receptacle (similar to vehicle safety belts), or the like.

The belt 80 also comprises two (2) removably attachable equipment pouches 70, thereby providing a secure enclosure for tools-of-the-trade such as, but not limited to: stethoscope, scissors, bandages, and the like. The equipment pouches 70 are located thereon a front left and a front right side portion of the belt 80 and are attached, removed, opened, and closed via a conventional hook-and-loop fastener. Each pouch comprises a flap 71, a flap hook fastener 72, a flap loop fastener 73, an internal surface 74, and a rear pouch loop fastener 75. In use, the flap 71 opens in an upward direction, thereby revealing an internal surface 74 to store desired items therein. The flap 71 is secured and opened via the flap hook fastener 72 engaging and disengaging the flap loop fastener 73, respectively. The flap hook fastener 72 is located thereon an exterior front surface of the pouch 70 and the flap loop fastener 73 is located therein an interior surface of the flap 71. Each pouch 70 is secured and removed to the belt 80 via the rear pouch loop fastener 75 engaging and disengaging a belt hook fastener 76, respectively. The equipment pouches 70 are fabricated from materials such as, but not limited to: leather, nylon, textile, or the like.

The belt 80 further comprises a pair of sewn-in "D" hooks 85, thereby providing a secure position for the lifting hooks 22 to attach thereto when not in use. The "D" hooks are located at an intermediate vertical position along the side surface of the belt 80 and are attached to said belt 80 via conventional sewing techniques. The "D" hooks 85 are fabricated from materials such as but not limited to: metals, plastics, and the like.

The apparatus 10 also comprises an adjustable harness 30, thereby providing a stabilizing and conforming means thereto users 90 of various torso sizes and shapes. The harness 30 transfers the additional lifted weight from the back to the legs of the user 90. The harness 30 comprises a first vertical strap 32 and a second vertical strap 34 and each is attached thereto an upper front and an upper rear perimeter surface of the belt 80 positioned thereon the right and left portions via conventional looped and sewn connections. Each vertical strap 32, 34 comprises a length adjustment means 100, thereby enabling the user to adjust the harness 30 to a desired length. The length adjustment means 100 may be provided in a variety of commercially available fixture styles and materials which provide similar adjusting functionality such as, but not limited to: luggage hooks, tri-glides, or the like. The harness 30 is fabricated from, but not limited to: leather, nylon, textile, or the like.

The harness 30 also comprises a lateral lifting strap 20, thereby providing additional stability when lifting the emergency litter. The lateral lifting strap 20 comprises pair of non-captive lifting hooks 22 which hooks thereonto the emergency litter. The lifting hooks 22 are located thereon the tail ends of each lateral lifting strap 20 and are preferably integrally molding into each lateral lifting strap 20. The lateral lifting strap 20 also comprises a pair of lifting loops 24 which are comprised of sewn-in textile loops, thereby providing a position for the user's 90 hands to be inserted thereinto and grasp the lifting straps 20, thereby improving lifting and stability of the apparatus 10 to an upright position. The lateral lifting strap 20 further comprises a pair of intermediately placed length adjustment means 100, similar to the harness 30, thereby enabling the user to adjust either side of the lifting strap 20 to a desired length. The lateral lifting strap 20 is located thereon the shoulder position of the harness 30 and wrapped around thereto a rear portion of the harness 30.

Referring now to FIG. 2*a*, an environmental view of a front portion of the apparatus 10 and FIG. 2*b*, a close-up view of the hook 50 of the apparatus 10, according to the preferred embodiment of the present invention, are disclosed. The apparatus 10 also comprises a sternum belt 84, thereby providing additional securing means of said apparatus 10 to the user and an additional placement of the hook 50. The sternum belt 84 is attached to an inner perimeter surface of the first vertical strap 32 and an inner perimeter surface of the second vertical strap 34 in a perpendicular location thereto. The sternum belt 84 comprises a sternum belt buckle 86 providing a securing and conforming means thereto users 90 of various chest sizes. The sternum belt buckle 86 comprises a conventional buckling fixture that fastens the ends of the sternum belt 84 via techniques such as, but not limited to: apertures and a pivoting rod (similar to a conventional pant belt buckles), a belt receptacle (similar to vehicle safety belts), or the like.

The apparatus 10 also comprises a removably attachable non-captive hook 50 which is strapped into the belt 80 or sternum belt 84, thereby supporting an emergency litter to said apparatus 10 at waist height or at chest height when the user 90 is in an upright position. The hook 50 is fabricated from a durable material such as, but not limited to: steel, aluminum, or the like. The hook 50 comprises a belt anchor 56 which attaches the hook 50 to the belt buckle 82 or sternum belt buckle 86 on the apparatus 10. The belt anchor 56 utilizes a sliding attachment system thereto position the hook 50 therewithin the belt buckle 82 portion of the belt 80 or sternum belt buckle 86 portion of the sternum belt 84, thereby providing quick fastening and detaching of the hook 50 therefrom said belt buckle 82. Preferably the belt 80 or sternum belt 84 is positioned superjacent to a belt anchor 56 and said belt 80 or said sternum belt 84 is then wrapped over an upper surface of a lower support 54. The hook 50 comprises an upper support 52 and a lower support 54 utilized to sustain the emergency litter therein. The upper support 52 and lower support 54 provide the user with two (2) height positions to rest the emergency litter upon when utilizing the apparatus 10. Both the upper support 52 and the lower support 54 comprise a "U"-shaped horizontally disposed and configured parallel to the waist of the user 90 when secured in place on the sternum belt 84.

Referring now to FIG. 3, an environmental view of a rear portion of the apparatus 10, according to the preferred embodiment of the present invention, is disclosed. The apparatus 10 comprises a neck pad 60, thereby providing protection and increased comfort to the user 60 while lifting loads heavy. The neck pad 60 is affixed to the rear upper portion of the harness 30 and is situated perpendicular to said harness 30. The neck pad 60 is directed toward the user 90, thereby providing comfort against the user's neck. The neck pad 60 is preferably fabricated from a foam rubber, yet other materials may be utilized without limiting the functions of the apparatus 10.

Thereupon the neck pad 60 is a plurality of strap guides 26 which are used in conjunction with the lateral lifting strap 20. The strap guides 26 direct and contain the lateral lifting strap 20 thereto the load bearing area of the users 90 shoulders. The strap guides 26 are sewn thereinto the neck pad 60 in a conventional manner and fabricated from materials such as, but not limited to: nylon, leather, textiles, or the like.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

The method of utilizing the apparatus 10 may be achieved by performing the following steps: positioning the harness 30 on the user 90 (similar to putting on a jacket); adjusting the length adjustment fittings 100 thereon the vertical straps 32, 34 and lateral lifting straps 20 to a desired length; placing the lifting hooks 22 thereon the "D" hooks 85; removing the pouches 70 as desired, thereby disengaging the rear pouch loop fastener 75 from the belt hook fastener 76; opening a desired pouch 70, thereby lifting the flap 71 and disengaging the flap hook fastener 72 from the flap loop fastener 73; positioning desired items into the internal surface 74; closing the flap 71, thereby engaging the flap hook fastener 72 to the flap loop fastener 73; attaching the desired pouch 70 onto the belt 80, thereby engaging the rear pouch loop fastener 75 to the belt hook fastener 76; inserting the belt anchor 56 of the hook 50 therebetween the belt buckle 82 or sternum belt buckle 86 and securing said belt buckle 82 or said sternum belt buckle 86 in a conventional manner; positioning the emergency litter by lifting it thereupon the upper support 52 or lower support 54 of the hook 50; unhooking the lifting hooks 22 from the "D" hooks 85 and placing them thereupon the emergency litter if additional stabilization is necessary; and lifting the emergency litter to the users 90 upright position by means of the apparatus 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A lifting aid, comprising:

a belt for encompassing a waist of a user, further comprising a belt adjustment means;

a harness affixed to said belt, comprising:

a lifting strap comprising a pair of durable and resilient lifting hooks located opposing ends thereof;

a first vertical strap affixed to a first upper front perimeter surface and a first upper rear perimeter surface of said belt, further comprising a first vertical strap adjustment means and a first strap guide;

a second vertical strap affixed to a second upper front perimeter surface and a second upper rear perimeter surface of said belt, further comprising a second vertical strap adjustment means and a second strap guide;

a sternum belt affixed at either end to an intermediate location of said first vertical strap and said second vertical strap, further comprising a sternum belt adjustment means; and, said lifting strap routed through each said first and second strap guide, further comprising a pair of lifting loops each affixed to an intermediate outer surface thereof and a pair of lifting strap adjustment means; and, a durable and resilient front hook removably attachable to lifting aid;

wherein said lifting aid further provides a back support means to said user when lifting a load;

wherein said first vertical strap is worn around a first shoulder of said user;

wherein said second vertical strap is worn around a second shoulder of said user;

wherein said sternum adjustment means provides an independent means for adjusting a length of said sternum belt;

wherein said pair of lifting loops provide an improved lifting means and stability means for said lifting aid;

wherein said pair of strap adjustment means provides an independent means for adjusting a length of each side of said lifting strap;

wherein said adjustable belt provides a lower lumbar supporting means;

wherein said pair of lifting hooks provides a second removable securing means for said harness to said load;

wherein said front hook is located in a front position of said user when said lifting aid is worn; and, wherein said front hook provides a first removable securing means for said harness to said load.

2. The lifting aid of claim 1, wherein said belt further comprises a pair of affixed auxiliary hooks;

wherein said pair of auxiliary hooks are located on opposing hip locations of said user when said lifting aid is worn;

wherein said pair of auxiliary hooks provides a secure attachment means for said pair of lifting hooks when not in use.

3. The lifting aid of claim 1, wherein said pair of lifting hooks further comprises a non-captive hook.

4. The lifting aid of claim 1, wherein said belt adjustment means and said sternum adjustment means each further comprise a buckle.

5. The lifting aid of claim 4, wherein said front hook further comprises:

a belt anchor;

an upper support member; and, a lower support;

wherein said load is selectively supported on said upper support member or said lower support member.

6. The lifting aid of claim 5, wherein said front hook is selectively removably attachable to said belt adjustment means or said sternum belt adjustment means;

wherein said belt anchor is slidingly engaged within either said belt adjustment means or said sternum belt adjustment means and secured therein.

7. The lifting aid of claim 1, wherein said belt and said harness comprise one of the following list: leather, nylon, or textile.

8. The lifting aid of claim 1, further comprising at least one pouch removably attachable to said belt, each further comprising:

a pouch body, defining an internal surface and a top opening;

a flap affixed to a rear wall of said pouch body for covering said opening;

a flap fastening means for securing said flap to a front wall of said pouch body; and, a pouch fastening means;

wherein said pouch fastening means fastens a rear wall of said pouch body to said belt.

9. A lifting aid, comprising:

a belt for encompassing a waist of a user, further comprising a belt adjustment means;

a harness affixed to said belt, comprising:

a lifting strap comprising a pair of durable and resilient lifting hooks located opposing ends thereof;

a first vertical strap affixed to a first upper front perimeter surface and a first upper rear perimeter surface of said belt, further comprising a first vertical strap adjustment means and a first strap guide;

a second vertical strap affixed to a second upper front perimeter surface and a second upper rear perimeter surface of said belt, further comprising a second vertical strap adjustment means and a second strap guide;

a sternum belt affixed at either end to an intermediate location of said first vertical strap and said second vertical strap, further comprising a sternum belt adjustment means; and, said lifting strap routed through said plurality of neck pad strap guides and each said first and second strap guide, further comprising a pair of lifting loops each affixed to an intermediate outer surface thereof and a pair of lifting strap adjustment means;

a neck pad adjustably attached to said harness with a plurality of neck pad strap guides; and, a durable and resilient front hook removably attachable to lifting aid;

wherein said lifting aid further provides a back support means to said user when lifting a load;

wherein said first vertical strap is worn around a first shoulder of said user;

wherein said second vertical strap is worn around a second shoulder of said user;

wherein said sternum adjustment means provides an independent means for adjusting a length of said sternum belt;

wherein said pair of lifting loops provide an improved lifting means and stability means for said lifting aid;

wherein said pair of strap adjustment means provides an independent means for adjusting a length of each side of said lifting strap;

wherein said adjustable belt provides a lower lumbar supporting means;

wherein said pair of lifting hooks provides a second removable securing means for said harness to said load;

wherein said neck pad further comprises a comfortable and protective neck and lower head supporting means when said lifting aid lifting said load;

wherein said front hook is located in a front position of said user when said lifting aid is worn; and, wherein said front hook provides a first removable securing means for said harness to said load.

10. The lifting aid of claim 9, wherein said belt further comprises a pair of affixed auxiliary hooks;

wherein said pair of auxiliary hooks are located on opposing hip locations of said user when said lifting aid is worn;

wherein said pair of auxiliary hooks provides a secure attachment means for said pair of lifting hooks when not in use.

11. The lifting aid of claim 9, wherein said pair of lifting hooks further comprises a non-captive hook.

12. The lifting aid of claim 9, wherein said belt adjustment means and said sternum adjustment means each further comprise a buckle.

13. The lifting aid of claim 12, wherein said front hook further comprises:

a belt anchor;

an upper support member; and, a lower support;

wherein said load is selectively supported on said upper support member or said lower support member.

14. The lifting aid of claim 13, wherein said front hook is selectively removably attachable to said belt adjustment means or said sternum belt adjustment means;

wherein said belt anchor is slidingly engaged within either said belt adjustment means or said sternum belt adjustment means and secured therein.

15. The lifting aid of claim 9, wherein said belt and said harness comprise one of the following list: leather, nylon, or textile.

16. The lifting aid of claim 9, further comprising at least one pouch removably attachable to said belt, each further comprising:

a pouch body, defining an internal surface and a top opening;

a flap affixed to a rear wall of said pouch body for covering said opening;

a flap fastening means for securing said flap to a front wall of said pouch body; and, a pouch fastening means;

wherein said pouch fastening means fastens a rear wall of said pouch body to said belt.

* * * * *